United States Patent [19]

Fisher et al.

[11] Patent Number: 4,604,863

[45] Date of Patent: Aug. 12, 1986

[54] PIGTAIL GUIDE FOR STAPLE SPINNING

[75] Inventors: Don E. Fisher, Pensacola; John W. Fuqua, Milton; Arnold E. Wilkie, Pensacola Beach, all of Fla.

[73] Assignee: Monsanto Company, St. Louis, Mo.

[21] Appl. No.: 695,513

[22] Filed: Jan. 28, 1985

[51] Int. Cl.[4] ..... D01H 13/04; D01H 7/10

[52] U.S. Cl. ..... 57/352; 57/354; 242/157 C

[58] Field of Search ..... 57/352, 354, 355, 356, 57/358, 360, 119, 122; 242/157 R, 157 C, 149

[56] References Cited

U.S. PATENT DOCUMENTS

| | | | |
|---|---|---|---|
| 1,793,092 | 2/1931 | Jespersen | 242/149 |
| 2,839,887 | 6/1958 | Breazeale | 57/358 |
| 3,083,931 | 4/1963 | Dechene | 242/157 C |
| 3,084,500 | 4/1963 | Recher | 57/352 |
| 3,449,900 | 6/1969 | Eldridge et al. | 57/352 X |

*Primary Examiner*—Donald Watkins

*Attorney, Agent, or Firm*—John W. Whisler

[57] ABSTRACT

A specially designed pigtail balloon guide for use with ring spinning frames is provided. The guide improves the performance of such frames with respect to sliver breaks and/or sliver throughput. The guide has a single-looped coil through which the sliver is threaded. The coil is designed so that during operation of the frame the coil is tilted with respect to the path of the sliver.

16 Claims, 11 Drawing Figures

PIGTAIL GUIDE FOR STAPLE SPINNING

BACKGROUND OF THE INVENTION

A. Field of the Invention

This invention relates to a novel guide for use with staple ring spinning frames of the type wherein the front rolls of the frames are set back from the balloon guide at an angle of at least 10° from vertical. Use of the guide greatly improves the performance of such frames.

B. Description of the Prior Art

The conventional ring spinning frame used in the textile industry for converting sliver to yarn consists of a plurality of identical spinning positions or stations, each having means for drafting the sliver to a desired count and means for twisting and collecting the drafted sliver in the form of yarn. The term "sliver" as used herein includes roving and means a strand of staple fibers having little or no twist. The term "yarn" as used herein means twisted sliver. The drafting means comprises three pairs of driven nip rolls referred to as back rolls, middle rolls and front rolls. Most of the drafting of the sliver occurs between the middle rolls and front rolls. The front rolls forward the drafted sliver from the drafting means to the twisting and collecting means. The twisting and collecting means comprises an upright, rotatable spindle adapted to receive a bobbin, a ring-and-traveler take-up mechanism assoicated with the spindle for inserting twist in the sliver as it is being forwarded by the front rolls and for winding the sliver onto a bobbin vertically mounted on the spindle.

The sliver in passing from the front rolls to the take-up mechanism passes into contact with a guide. The guide is located directly above the spindle and facilitates winding of the sliver onto the bobbin. The length of sliver between the guide and take-up mechanism rotates rapidly about the bobbin axis during operation of the spinning position, forming what is known as a balloon. Typically, the guide is a cylindrically-shaped wire having one end adapted to attach to a spinning frame position and at the other end a coil through which the sliver passes. The coil terminates in a straight piece extending outwardly from the coil to facilitate threading of the sliver through the coil. The coil with its terminating straight piece resembles a "pig's tail" and for this reason the guide is generally referred to as a "pigtail" balloon guide. That portion of the coil's surface over which the sliver makes rubbing contact during operation of the position is referred to as the "yarn contact surface" of the guide.

In practice, the productivity of the spinning position is maximized by operating the spindle at the practical limit of its mechanical capability and then adjusting the peripheral speed of the front rolls so that just enough twist is inserted in the sliver to provide twist in the sliver at the nip of the front rolls so that the sliver will not break at the nip. Increasing the peripheral speed of the front rolls while maintaining the spindle speed constant will increase the delivery speed of the sliver to the traveler, thereby reducing the amount of twist inserted in the sliver which in turn causes the twist in the sliver to move away from the nip and toward the guide. In the absence of twist in the sliver at the nip of the front rolls, the sliver is weakened and pulls apart causing breaks or "ends down". Under normal operating conditions, ends down is caused by imperfections in the sliver (e.g. thin spots). Generally, 30 to 40 ends down per 1000 spindle hours is considered to be acceptable. Of course, it would be economically desirable to improve the performance of the spinning position by reducing the number of ends down per 1000 spindle without sacrificing productivity or by increasing productivity without increasing ends down or both.

U.S. Pat. No. 4,384,448 describes a method of improving the performance of ring spinning positions. The method consists of placing a pneumatic twister on a spinning position between the front rolls and guide, whereby during operation of the position false twist is inserted in the sliver in the same direction as the twist inserted by the traveler. False twist backs up the sliver from the twister into the nip of the front rolls, thereby permitting the position to be operated at higher than normal delivery speeds without increasing ends down or at normal delivery speeds with reduced ends down. In the case of carpet yarn, operating the position at the higher than normal delivery speeds while maintaining the speed of the spindle at its practical limit, provides staple yarn having less twist than normal which enhances the bulk and apparent value of the yarn. However, one drawback associated with using the method described in U.S. Pat. No. 4,384,448 is the cost of the twister and of supplying air to the twister during operation.

Accordingly, it is an object of the present invention to provide a more economical method for improving the performance of ring spinning positions.

SUMMARY OF THE INVENTION

The present invention provides a simple and economical means for effectively improving the performance of conventional ring spinning frames of the type having front rolls that are set back from the balloon guide at an angle of at least 10° from vertical. The invention comprises a specially designed balloon guide for use in combination with such frames. The guide is designed so that its yarn contact surface, when viewed from a point where the spindle is in front of the front rolls and also in line with the vertical centerline of the front rolls, tilts downwardly from left-to-right for use with spindles rotating in a clockwise direction and upwardly from left-to-right for use with spindles rotating in a counter-clockwise direction. In practice, the viewing point will be from directly in front of the spinning frame position. Usually, from this viewing point the guide and spindle are vertically in line with one another and the front rolls are behind and in the same vertical plane as the spindle and guide.

Heretofore, the relationship of the yarn contact surface of balloon guides to the sliver during operation of spinning frames was not thought to be particularly significant. Typically, the conventional balloon guide is designed such that during operation of the position, its yarn contact surface is perpendicular to the sliver.

By using the specially designed guide described herein in accordance with the present invention, the front rolls are capable of being operated at higher speeds than possible using the productivity of ring spinning frames can be greatly increased without increasing ends down and at the same time providing staple yarn having less twist, greater bulk and more apparent value or, alternatively, the frames can be operated at conventional speeds with a reduction in ends down and/or using a lower quality sliver.

One important aspect of the invention is that the guides of the present invention can be used with existing frames at substantially no additional cost since the cost of the guides is no more than the cost of guides presently used on spinning frames.

According to one aspect of the invention the guide is used in conjunction with a pneumatic false twister, the twister being used in accordance with the teaching of U.S. Pat. No. 4,384,448.

DESCRIPTION OF THE PREFERRED EMBODIMENT OF THE INVENTION

Figure 1:
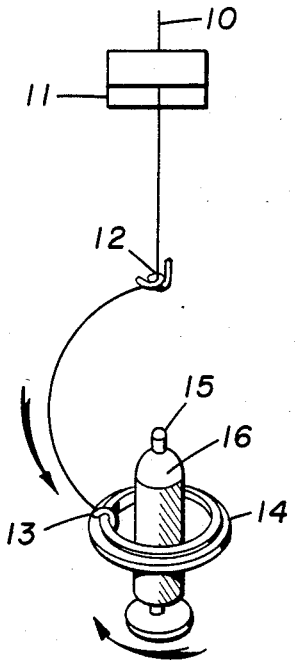
FIG. 1 is a front elevation of a representation of a ring spinning frame positin useful in practicing the present invention.
Figure 2:
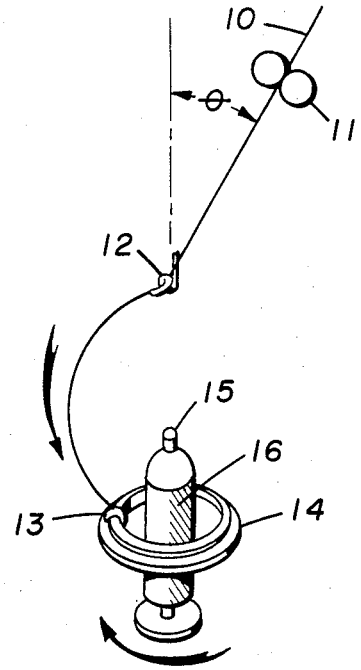
FIG. 2 is a side elevation of the ring spinning position of FIG. 1.

In accordance with the preferred embodiments of the invention the balloon guide of the present invention is used to improve the performance of existing spinning frame positions. Referring to FIGS. 1 and 2, such positions comprise drafting means having a pair of back nip rolls (not shown), a pair of middle nip rolls (not shown) and a pair of nip rolls 11 (front rolls), a pigtail balloon guide 12 of the present invention, a conventional ring-and-traveler take-up mechanism having a traveler 13 and a ring 14, and spindle 15. As shown in FIG. 2, front rolls 11 are disposed at an angle $\theta$ (sliver angle) from guide 12. Angle $\theta$ must be at least 10° from vertical. When angle $\theta$ is less than 10°, the improvement achieved by the present invention becomes negligible. In operation of the position, sliver 10 is passed through the drafting means, delivered by nip rolls 11 through guide 12 around traveler 13 with a partial wrap and wound onto bobbin 16 mounted on spindle 15 in an conventional manner. With spindle 15 operating at its highest mechanically feasible rpm, the peripheral speed of nip rolls 11 is adjusted to provide just enough twist in sliver 10 to keep the performance of the position at an acceptable level in terms of ends down per 1000 spindle hours.

Figure 3:
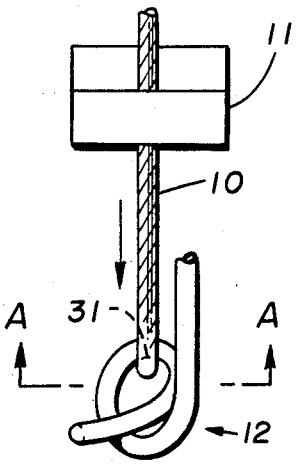
FIG. 3 is a plan view of the ring spinning position of FIG. 1 with the ring-and-traveler take-up mechanism, spindle and bobbin omitted.
Figure 4:
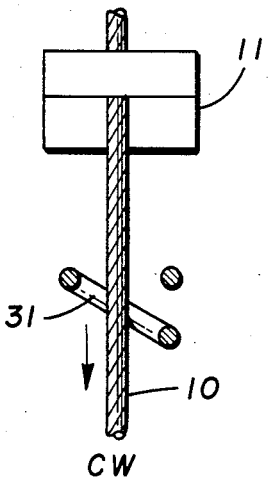
FIG. 4 is a front elevation taken along line A—A of FIG. 3 showing one embodiment of the guide.
Figure 5:
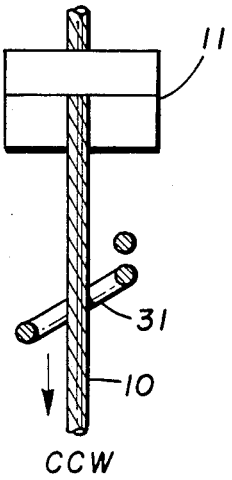
FIG. 5 is a front elevation taken along line A—A of FIG. 3 showing a second embodiment of the guide.
Figure 6:
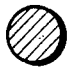
FIGS. 6, 7, and 8 are each a representation showing alternative cross-sections for the yarn contact surface of the guide shown in FIG. 3.
Figure 7:
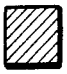
Figure 8:
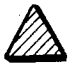

Referring to FIG. 3, pigtail balloon guide 12 includes a cylindrically-shaped body having one end portion (not shown) adapted for attachment to the spinning frame position and the other end portion in the shape of a single-looped coil terminating in a straight piece extending away from the coil. The coil has a yarn contact surface 31 over which sliver 10 rubs across during operation of the spinning position. Guide 12 differes from conventional pigtail balloon guides in that its yarn contact surface 31 is tilted downwardly from left to right when used on positions where the spindle rotates in a clockwise (CW) direction (see FIG. 4) and upwardly from left to right when used on positions where the spindle rotates in a counterclockwise (CCW) direction (see FIG. 5). When the spindle rotates in a CW direction, Z-twist is inserted in the sliver (see FIG. 4). When the spindle rotates in a CCW direction S-twist is inserted in the sliver (see FIG. 5). It has been discovered that with the arrangement shown in FIGS. 4 and 5 the yarn contact surface causes the sliver to revolve—like a bolt through a nut—thus providing extra twist in sliver 10 between guide 12 and front rolls 11 during operation of the position as sliver 10 rubs across yarn contact surface 31. The extra twist inserted in the sliver permits front rolls 11 to be operated at higher speeds than are otherwise possible without increasing ends down or at the same and reduce ends down. Increasing front roll speeds, provides yarn of lower twist and greater bulk. If the yarn contact surface is tilted in the opposite direction from that shown in FIGS. 4 and 5, the improvement is not achieved, in fact, ends down increases.

It has been found that the cross-sectional shape and/or size of the yarn contact surface of tilted guides of the present invention has an effect on the magnitude of the spinning performance improvement achieved thereby, for example, a triangular-shaped cross-sectional yarn contact surface tends to provide better spinning performance than a square-shaped cross-sectional surface which in turn tends to provide better performance than a circular-shaped cross-sectional surface. With regard to circular-shaped cross-sectional yarn contact surfaces, spinning performance tends to improve as the cross-sectional area of the surfaces is reduced. In general, the more gripping action imparted to the sliver by the yarn contact surface, the greater the improvement achievable by use of the guide. Of course, the cross-section of the yarn contact surface should not be of a size or shape so as to break or damage the sliver.

Instead of a tilted pigtail guide, any guide having the requisite tilted yarn contact surface may be used in practicing the invention, for example, the guide may be in the shape of a ring or half ring.

Figure 9:
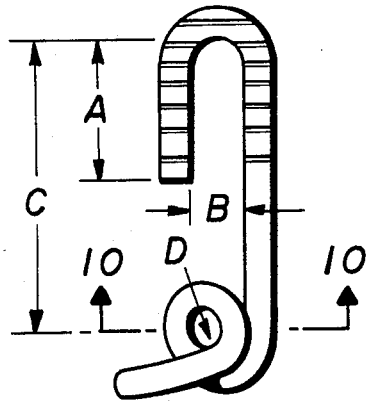
FIG. 9 is a plan view of a preferred pigtail guide of the present invention.
Figure 11:
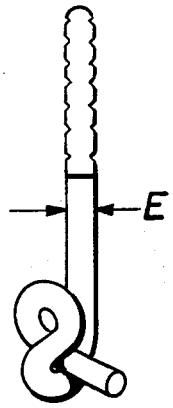
FIG. 11 is a left side elevation of the guide of FIG. 9.
Figure 10:
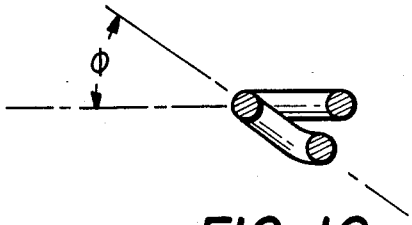
FIG. 10 is a front elevation taken along line 10—10 of FIG. 9.

The following example is given to further illustrate the invention. The tilted pigtail guide used in the example to illustrate the invention is shown in FIGS. 9–11.

The guide used consisted of a cylindrically-shaped wire U-shaped at one end for attachment to a ring spinning position and having at the other end a single-looped coil-terminating in a straight piece extending away from the coil for facilitating threading of sliver through the coil. The guide had a length of $2\frac{1}{2}$ inches (63.5 mm) and with reference to FIGS. 9–11 the following dimensions:

(a) 37/32 inch (23.6 mm)
(b) $\frac{3}{8}$ inch (9.5 mm)
(c) $1\frac{7}{8}$ inches (47.6 mm)
(d) 9/32 inch (7.1 mm)
(e) 5/32 inch (4.0 mm)
$\theta$ 35°

The guide is designed so that the sliver contacts only one surface of the guide during spinning operations. If the sliver contacts two or more surfaces of the guide, the ability of the guide to insert extra twist into the sliver during operation of the position is reduced. An angle $\phi$ (See FIG. 10) between 35° and 40° has been found to be optimum in conjunction with the spinning of $3\frac{1}{2}$ cotton count on frames where angle $\theta$ (See FIG. 2) is in the 20° to 30° range. It is contemplated that the dimensions and the size of angles $\phi$ and $\theta$ may be varied to achieve optimum or desired operating conditions without departing from the scope and spirit of the invention. For example, it is contemplated that angle $\phi$ of the guide could vary from 20° to 70°.

EXAMPLE

Nine positions of an Whitin NW carpet ring spinning frame were used to evaluate the tilted pigtail guide of the present invention. The angle $\phi$ from the bottom of the front rolls to the guide was 21.5°. The sliver used in performing the evaluation was 5.3 grams per meter sliver composed of nylon 66 staple having a length of 7½ inches (19.05 cm), a denier of 15 and an average of 9 crimps per inch (3.54 crimps per cm). The sliver was converted to 3.5 cotton count yarn having 3.01 turns per inch, tpi (11.9 turns per meter, tpm) using a twist multiplier of 1.60 and the following conditions:

Rolls Peripheral Speed ft./min. (cm/min.)
back rolls: 5.6 (170.69)
middle rolls: 6.5 (198.12)
front rolls: 161 (4907.28)
Spindle speed (rpm): 4900
direction: CW
Twist direction: Z In the first run, each position was fitted with a tilted guide of the present invention substantially as shown in FIGS. 9–11 and described above. The nine positions ran for approximately one hour and fifteen minutes and yielded 10 lbs. (4.5 kg.) of yarn with no breaks (ends down) on any of the nine positions.

In a second run the nine positions were again operated for approximately one hour and fifteen minutes using the same conditions and sliver that were used in the first run except this time standard guides were used instead of the tilted guides of the invention. The standard guides were identical to the tilted guides except $\phi$ in this distance was about 0° (i.e. less than 5°). In this instance, twelve yarn breaks (ends down) occurred during the run.

When Runs one and two were repeated except that the front rolls were slowed down to provide a yarn having 4½ tpi (17.7 tpm) the performance of the positions during both runs was satisfactory.

The results of Runs one and two show that the tilted guide of the present invention, as compared to standard guides, provides bulkier, lower twist yarn at higher sliver throughputs.

In a related run, 3.5 grams per meter sliver was converted to yarn having 3.01 tpi (11.9 tpm) on a single position using substantially the same conditions as used in run one except in this instance angle $\theta$ (See FIG. 2) was only 6.33°. In this instance, the tilted guide gave no significant improvement in the performance of the position over that achieved with a standard guide of the type used in Run 2. This run shows the importance of arranging the front rolls and pigtail guide so that angle $\theta$ is at least 10°.

In still further runs the tilted guide was used in combination with a pneumatic false twister in accordance with the teachings of U.S. Pat. No. 4,384,448. The false twister was placed just below the front rolls on each position of a 184-position Whitin NW spinning frame. The modified positions were operated to convert carpet sliver of the type described above in the previous runs to yarn of reduced twist at a higher sliver throughput rate than could be achieved without the pneumatic twister. Use of the tilted guide of the present invention significantly improved the performance of the modified positions as compared to use of a standard guide.

In still other related runs, the conditions of runs one and two were repeated, except in this instance the peripheral speed of the front rolls was adjusted to provide a yarn having 4½ tpi (17.7 tpm) of twist (normal operating conditions) and a low quality sliver was used. Use of the tilted pigtail guide of the present invention gave acceptable performance in terms of ends down per 1000 spindle hours, whereas the standard pigtail guide did not.

We claim:

1. In a ring spinning frame position for continuously converting sliver to yarn, said position comprising means for drafting sliver to a desired count including a pair of rotatable nip rolls for forwardly drafted sliver away from said drafting means, an upright rotatable spindle disposed below said nip rolls and being adapted to receive a bobbin, a ring-and-traveler take-up mechanism associated with said spindle for inserting twist in sliver and then winding the sliver onto a bobbin mounted on said spindle, and a pigtail balloon guide having an elongated body, one end of which is attached to said spinning frame position and the other end of which is in the shape of a single-looped coil terminating in a straight piece extending outwardly from the coil for threading of sliver through the loop, and being disposed between said nip rolls and said take-up mechanism for facilitating winding of sliver onto said bobbin, said guide being vertically in line with said spindle and having a yarn contact surface over which sliver makes rubbing contact enroute from said nip rolls to said take-up mechanism, wherein said nip rolls are disposed from said guide at an angle ($\theta$) of at least 10° from vertical, the improvement wherein said guide is characterized in that when viewed from a point where said spindle is in line with the vertical center line of said nip rolls said yarn contact surface is tiled downwardly from left-to-right for spindles rotating in a clockwise direction and upwardly from left-to-right for spindles rotating in a counter-clockwise direction.

2. The spinning position of claim 1 wherein said yarn contact surface is tilted at an angle ($\phi$) of at least 20° and less than 70° from horizontal.

3. The spinning position of claim 2 wherein angle $\theta$ is between 20° and 30°.

4. The spinning position of claim 2 wherein angle $\phi$ is between 35° and 40°.

5. The spinning position of claim 4 wherein angle $\theta$ is between 20° and 30°.

6. The spinning position of claim 5 wherein the pigtail balloon guide is a cylindrically-shaped wire.

7. In a ring spinning process wherein sliver is drafted, forwarded by a pair of nip rolls, twisted while being forwarded and collected on a bobbin mounted on an upright rotating spindle by means of a ring-and-traveler take-up mechanism and wherein the sliver in passing from said nip rolls to aid take-up mechanism passes through a pigtail balloon guide having a single-looped coil and makes rubbing contact with the surface of said coil whereby the sliver balloons outwardly between said guide and said take-up mechanism, said frame being of the type wherein said nip rolls are disposed from said guide at an angle ($\theta$) of at least 10° from vertical, the improvement wherein sad guide is characterized in that when viewed from a point where the spindle is in line with the vertical center line of said nip rolls, the surface of the guide in rubbing contact with the sliver (yarn contact surface) is tilted downwardly from left-to-right for spindles rotating in a clockwise direction and upwardly from left-to-right for spindles rotating in a counterclockwise direction.

8. The process of claim 7 wherein said yarn contact surface which is tilted at an angle ($\phi$) of at least 20° and less than 70° from horizontal.

9. The process of claim 8 wherein angle $\theta$ is between 20° and 30°.

10. The process of claim 8 wherein angle $\phi$ is between 35° and 40°.

11. The process of claim 10 wherein angle $\theta$ is between 20° and 30°.

12. The process of claim 11 wherein the pigtail balloon guide is a cylindrically-shaped wire.

13. A pigtail balloon guide having an elongated body adapted for attachment at one end thereof to a spinning frame position and a single-looped coil at the other end terminating in a straight piece extending outwardly from the coil for threading of sliver through the loop, said loop being characterized in that when the guide is attached to a spinning frame position the plane of said loop is tilted at an angle of at least 20° and less than 70° from horizontal.

14. The guide of claim 13 wherein said angle is between 35° and 40°.

15. The guide of claim 13 having a cylindrically-shaped body.

16. The guide of claim 13 wherein said body has a triangular cross-section.

* * * * *